US007435050B2

(12) United States Patent
Welch

(10) Patent No.: US 7,435,050 B2
(45) Date of Patent: Oct. 14, 2008

(54) SPLIT FLANGE V-GROOVE AND ANTI-ROTATION MATING SYSTEM

(75) Inventor: David A. Welch, Quaker Hill, CT (US)

(73) Assignee: United Technologies Corporation, Hartford, CT (US)

( * ) Notice: Subject to any disclaimer, the term of this patent is extended or adjusted under 35 U.S.C. 154(b) by 292 days.

(21) Appl. No.: 11/329,554

(22) Filed: Jan. 11, 2006

(65) Prior Publication Data

US 2007/0160471 A1 Jul. 12, 2007

(51) Int. Cl.
*F04D 29/40* (2006.01)
*F01D 25/24* (2006.01)

(52) U.S. Cl. ..... 415/214.1; 415/201

(58) Field of Classification Search ..... 415/214.1, 415/201; 403/262, 335, 336, 337, 338
See application file for complete search history.

(56) References Cited

U.S. PATENT DOCUMENTS 4,522,434 A * 6/1985 Webb ..... 285/112
5,954,476 A * 9/1999 Stewart et al. ..... 415/214.1

* cited by examiner

*Primary Examiner*—Edward Look
*Assistant Examiner*—Dwayne J White
(74) *Attorney, Agent, or Firm*—Bachman & LaPointe, P.C.

(57) ABSTRACT

There is provided a turbine engine component, such as a duct pipe, comprising an annular flange, at least one element, such as two duct pipe halfs, to be mated to the flange, and mating system for joining the at least one element to the flange. The mating system includes a first annular groove in the flange, which groove has two opposed planar wall portions for preventing axial movement of the at least one element relative to the flange. In a preferred embodiment, the mating system also includes a second annular groove in the flange. A sealing element is positioned within the second annular groove.

31 Claims, 7 Drawing Sheets

SPLIT FLANGE V-GROOVE AND ANTI-ROTATION MATING SYSTEM

STATEMENT OF GOVERNMENT INTEREST

The Government of the United States of America may have rights in the present invention as a result of Contract No. N00019 02 C 3003 awarded by the Department of the Navy.

BACKGROUND OF THE INVENTION (1) Field of the Invention

The present invention relates to a mating system for joining together various parts of a turbine engine component.

(2) Prior Art

Turbine engine components are often formed by multiple parts which have to be joined together. Most frequently, the parts are joined together by a plurality of fasteners. Due to the complexity of the parts and the little room for mechanics to assemble them, the cost of assembling and disassembling the parts can be great. Additionally, the cost of manufacturing the parts can be significant.

There is needed a mating system for joining various parts of a turbine engine component which uses no fasteners in the mating interface and which facilitates removal and assembly in the field.

SUMMARY OF THE INVENTION

The present invention provides a means for assembling a first part of a turbine engine component, such as a full hoop flange, fastened to a second part, such as a rigid interface, to a plurality of other parts, such as two half hoop (split flange) parts, with no fasteners in the mating interface.

In accordance with the present invention, there is provided a turbine engine component broadly comprising an annular flange, at least one element to be mated to the flange, and mating means for joining the at least one element to the flange. The mating means includes a first annular groove in the flange, which groove has two opposed planar wall portions for preventing axial movement of the at least one element relative to the flange. In a preferred embodiment, the mating means also includes a second annular groove in the flange. A sealing element is positioned within the second annular groove.

Further, in accordance with the present invention, there is provided an annular flange to be used in the mating system of the present invention. The annular flange broadly comprises a first annular groove in the flange, which first annular groove has a first planar wall and a second planar wall, and a third planar wall adjacent the second planar wall. The third planar wall is angled with respect to the second planar wall so as to form a substantially V-shaped groove with the first planar wall.

Still further, in accordance with the present invention, there is provided a mating system for joining a first part to a second part. The mating system broadly comprises a first annular groove in the first part, an angled surface on the first part adjacent the first annular groove, a tongue on the second part for insertion into the first annular groove, and a mating angled surface on the second part for abutting the angled surface on the first part when the tongue is inserted into the first annular groove.

Other details of the split flange V-groove and anti-rotation mating system of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
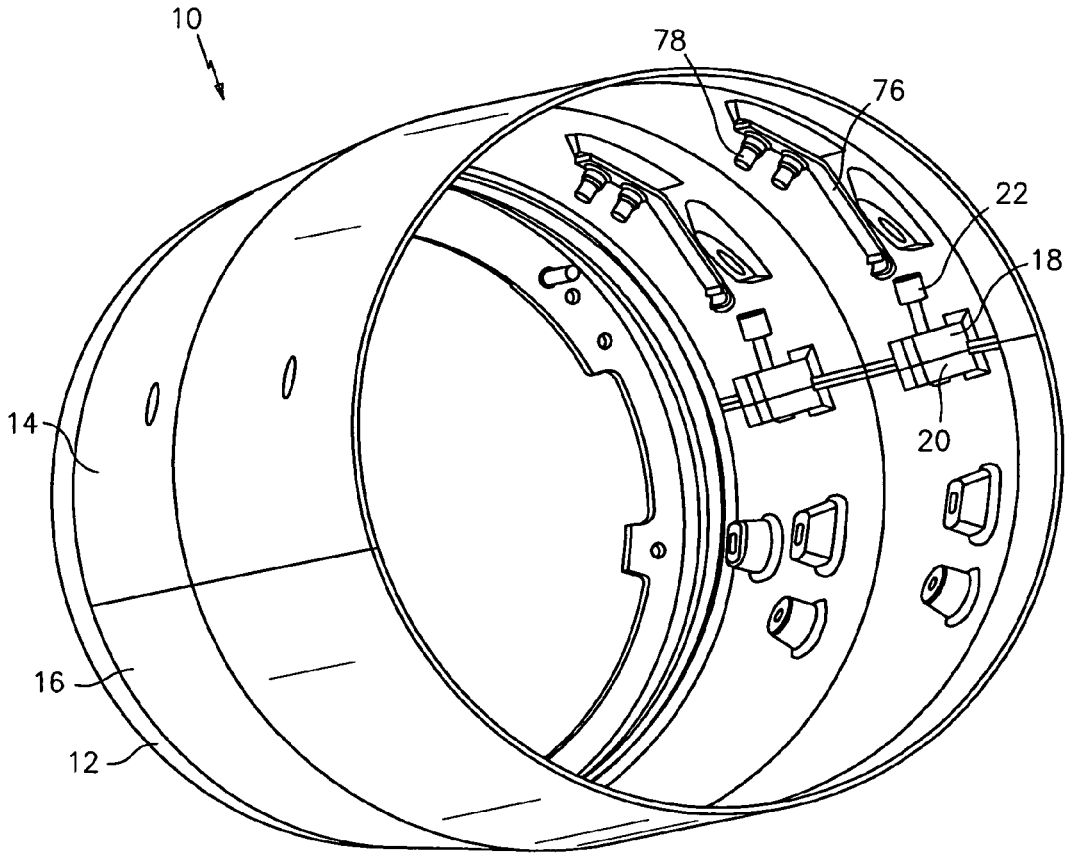
FIG. 1 is a perspective view of a turbine engine component employing the mating system of the present invention.

Referring now to the drawings, FIG. 1 illustrates a turbine engine component 10, such as a duct pipe in which a drive assembly (not shown) may be positioned. The turbine engine component 10 includes a full hoop or annular flange 12 to which duct pipe halfs 14 and 16 are attached. Each duct pipe half 14 and 16 has a half hoop or semi-annular configuration. The duct pipe half 14 has a plurality of spaced apart split flanges 18. The duct pipe half 16 has a plurality of mating spaced apart split flanges 20 which abut the flanges 18 when the duct pipe halfs 14 and 16 are assembled and abut each other. As will be discussed later, a fastener 22, such as a bolt or screw, may be used to join each pair of split flanges 18 and 20, and thus the duct pipe halfs 14 and 16, together.

Figure 2:
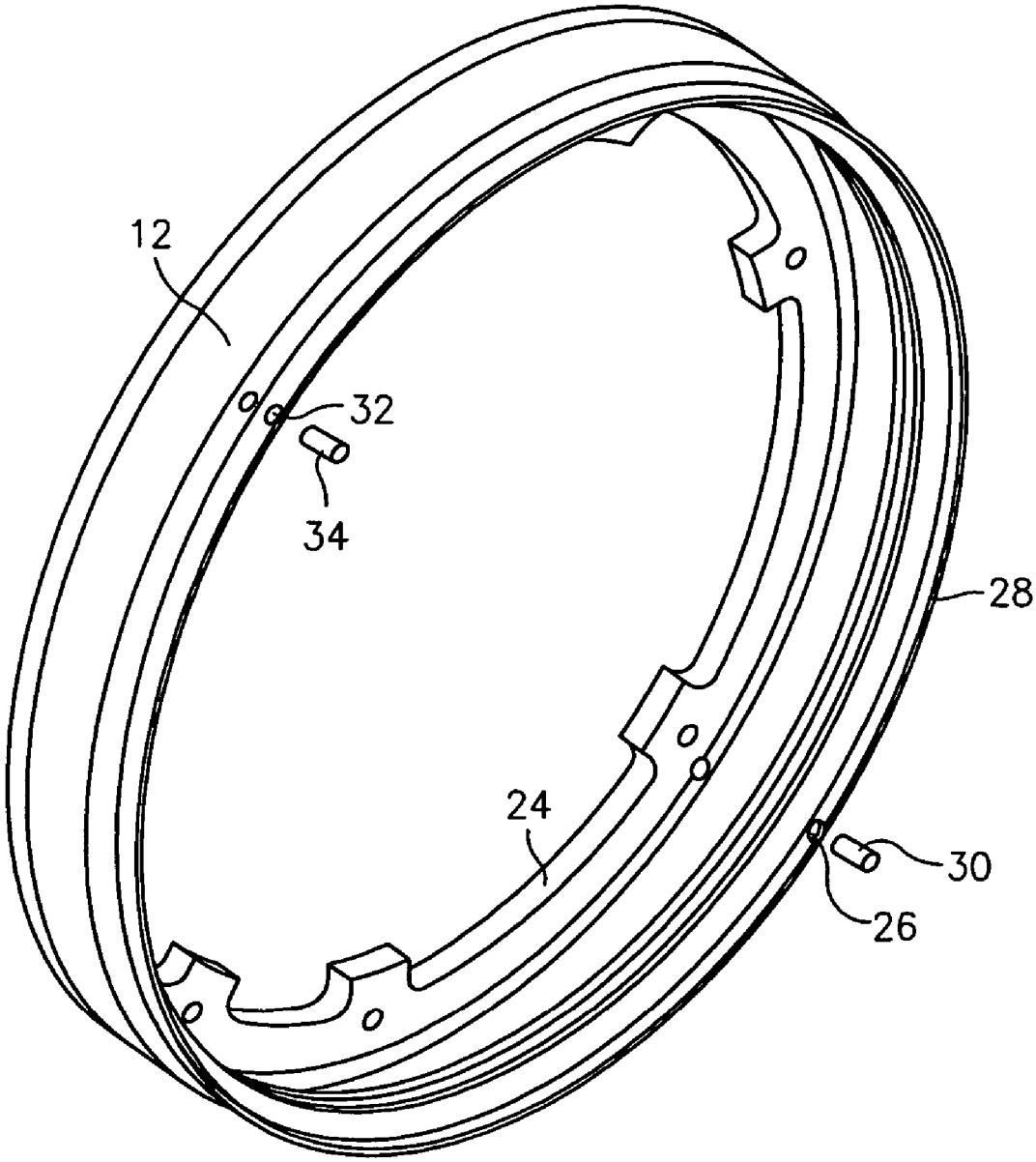
FIG. 2 is a perspective view of the a full hoop flange used in the turbine engine component of FIG. 1.

The full hoop or annular flange 12 used in the component 10 is illustrated in FIG. 2. The flange 12 includes an annular internal wall structure 24. The flange 12 also has a first slot 26 machined in a leading edge 28 for receiving a clock and lock pin 30 whose function will be described hereinbelow. The leading edge 28 also has a second slot 32 for receiving an anti-rotation pin 34. In a preferred embodiment, the pin 30 is press fit into the slot 26 and the pin 34 is press fit into the slot 32. In a preferred embodiment, the slot 26 is diametrically opposed to the slot 32.

Figure 3:
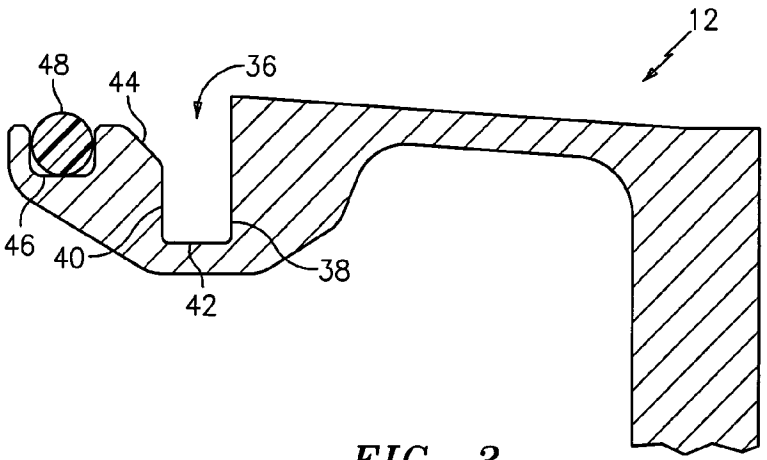
FIG. 3 is a partial sectional view of the flange of FIG. 2.

Referring now to FIG. 3, there is shown a sectional view of a portion of the flange 12. As can be seen from this figure, the flange 12 has a first annular groove 36. The annular groove 36 has a pair of opposed planar walls 38 and 40 that are joined together by a planar wall 42. The planar walls 38 and 40 help prevent axial movement of a respective duct pipe half mated to the flange 12. The groove 36 further has a surface 44 for preventing radial movement of the mating duct half. The surface 44 is angled with respect to the wall 38. It can be said that the surface 44 and the wall 38 form a substantially V-shaped groove portion.

The flange 12 also has a second annular groove 46. The second groove 46 is used to house a sealing element 48, such as an O-ring formed from rubber or a plastic material.

Figure 4:
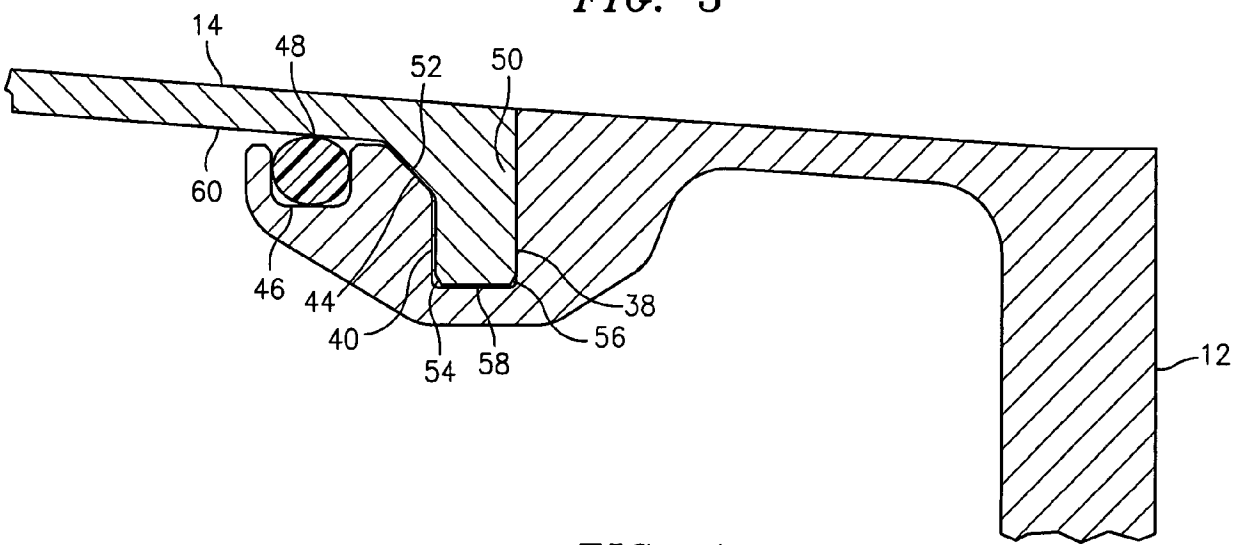
FIG. 4 is a partial sectional view of a duct pipe half mated to the flange of FIG. 2.

Referring now to FIG. 4, there is shown a sectional view of one of the duct pipe halfs 14 mated to the flange 12. The duct pipe half 14 has a tongue portion 50 which fits between the walls 38 and 40 and an angled portion 52 which mates and abuts the surface 44. If desired, the tongue portion 50 may have beveled edges 54 and 56 and a flat portion 58. The flat portion 58, along with the planar wall 42, helps alleviate residual stresses. In a preferred embodiment of the present invention, the tongue portion 50 has a width slightly less than the distance between the walls 38 and 40.

The duct pipe half 14 has a substantially planar portion 60 that abuts the angled portion 52. The substantially planar portion 60 overlaps the groove 46 and serves to compress the sealing element 48 when the duct pipe halfs 14 and 16 are mated to the flange 12. When compressing the sealing element 48, this interface allows the mating system to sustain a positive pressure.

While the duct pipe half shown in FIG. 4 has been identified by the reference numeral 14, it should be noted that the duct pipe half 16 would have a similar mating structure.

It should be noted that using the mating system of the present invention the duct pipe half 14 or 16 and the flange 12 are mated together without any bolt, screw, or other fastener in the mating interface. The absence of any bolt, screw or other fastener in the mating interface is noteworthy in that it allows the respective duct pipe half 14 or 16 to be rotated relative to the flange 12 as needed during assembly.

Figure 5:
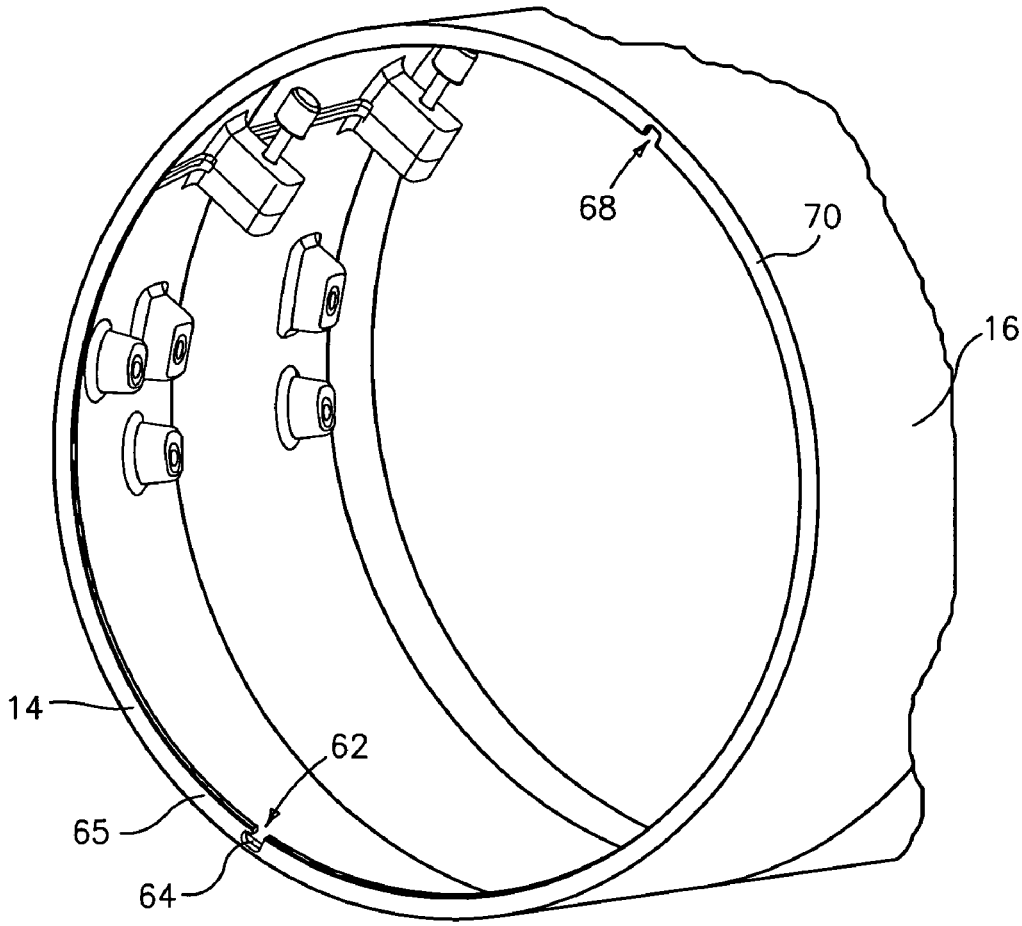
FIG. 5 is an end view of the duct pipe halfs.
Figure 6:
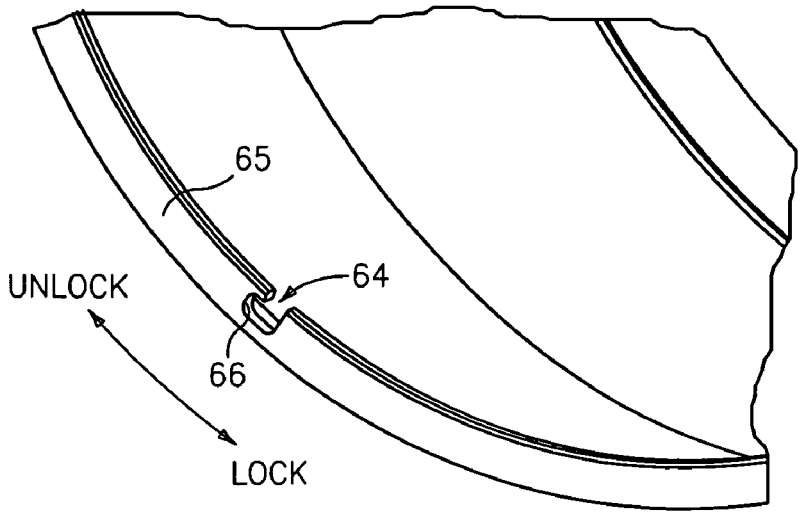
FIG. 6 is a partial end view of a bayonet slot in one of the duct pipe halfs.

Referring now to FIGS. 5 and 6, there is illustrated the two duct pipe halfs 14 and 16. The duct pipe half 14, which is preferably the lower half, may be provided with a clock and lock feature 62 in the form of a bayonet slot 64 in an end wall 65. As can be seen from FIG. 6, the bayonet slot 64 has a notch 66. The bayonet slot 64 receives the clock and lock pin 30. After the pin 30 has been positioned in the slot 64, the duct pipe half 14 is rotated so that the pin 30 is seated within the notch 66. Thus, the duct pipe half 14 is in a locked position. If needed, the duct pipe half 14 can be rotated in the opposite direction so that the pin 30 moves out of the notch 66 and the duct pipe half 14 is in an unlocked position. The clock and lock pin 30 and the bayonet slot 64 allow the duct pipe half 14 to retain its position for assembly purposes and to support itself while certain installations are made within the duct pipe half 14.

The duct pipe half 16 preferably forms the upper half. The duct pipe half 16 may be provided with a substantially U-shaped slot 68 in an end wall 70. The substantially U-shaped slot 68 receives the anti-rotation pin 34 when the duct pipe half 16 is in position. The anti-rotation pin 34 and the slot 68 prevent rotation of the assembled duct pipe halfs 14 and 16 relative to the flange 12.

Figure 7:
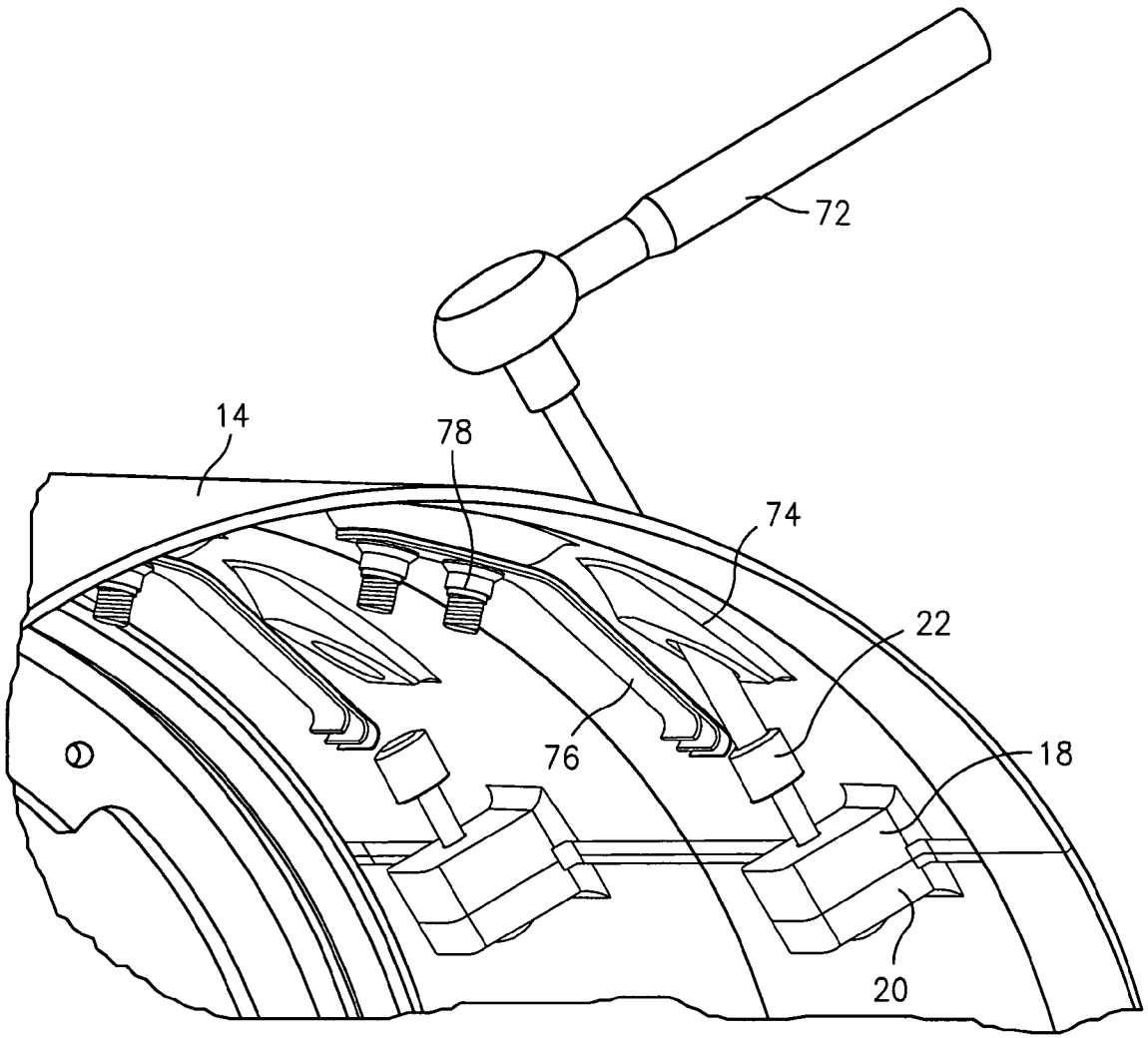
FIG. 7 is a perspective view showing a tool for joining a set of split flanges together.

Referring now to FIG. 7, after the duct pipe half 16 has been positioned to abut the duct pipe half 14 so that the split flanges 18 and 20 abut each other, a tool 72, such as a drive wrench, may be inserted through a door or opening 74 in the duct pipe half 14. The tool 72 contacts the fastener 22 and moves it into a position where it joins a set of the split flanges 18 and 20. As can be seen from FIG. 1, the duct pipe halfs 14 and 16 have a plurality of sets of split flanges 18 and 20. Thus, there are a plurality of doors 74 in the duct pipe half 14 to allow access to each fastener 22 associated with each set of split flanges 18 and 20. When each of the fasteners 22 has been tightened to a locked position, the duct pipe halfs 14 and 16 are joined to each other and to the flange 12.

In a preferred embodiment, a deflected baffle assembly 76 may be provided adjacent each door 74 to prevent leakage from an air flow path. Each deflected baffle assembly 76 may be joined to the duct pipe half 14 by one or more screws 78. Preferably, each deflected baffle assembly comprises a plurality of baffle members.

Figure 8:
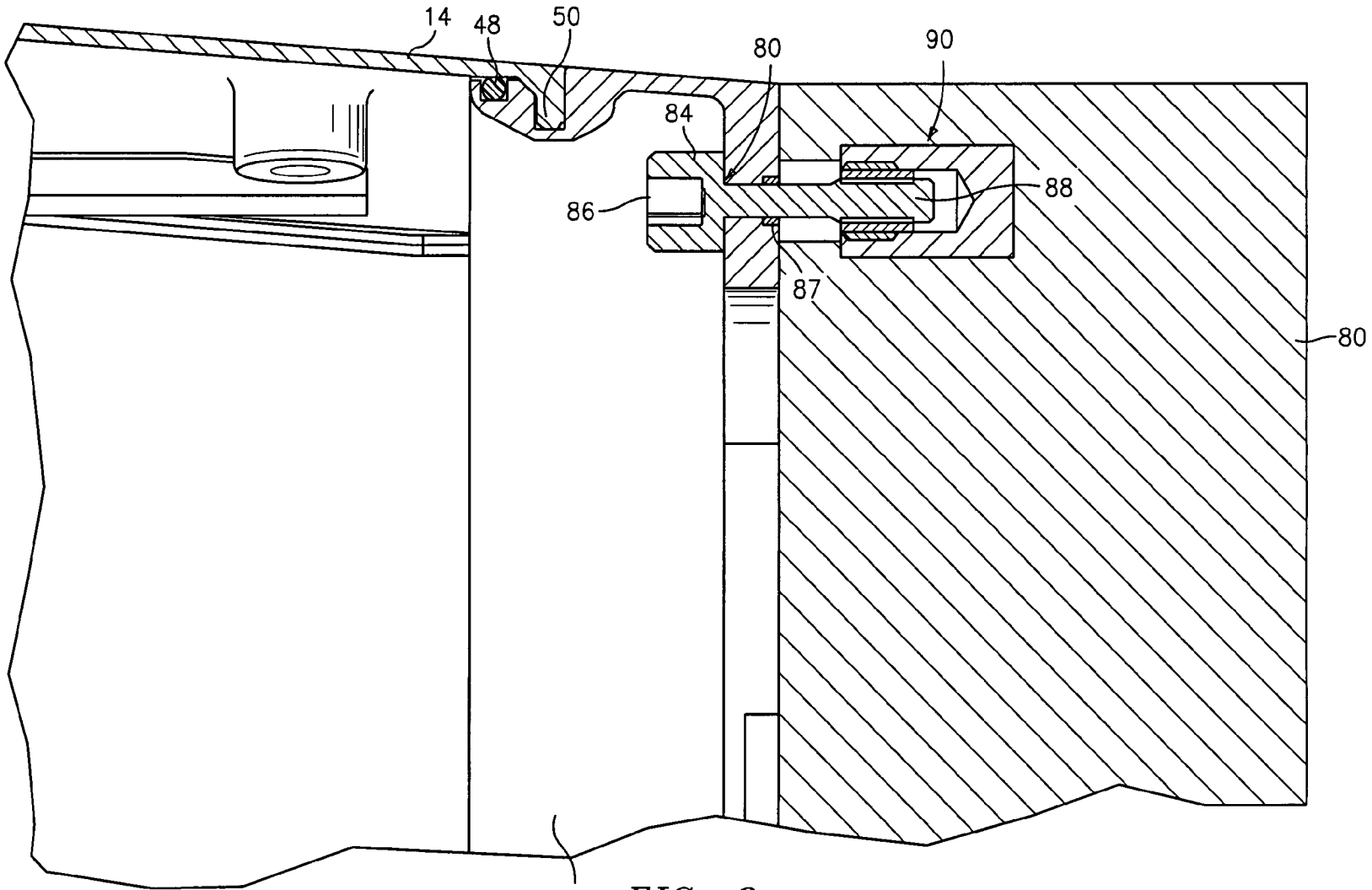
FIG. 8 is a sectional view showing a mating body joined to the flange.

Referring now to FIG. 8, the flange 12 may be joined to an annular hollow mating body 80 by a plurality of flange retention bolts 82. Each retention bolt 82 has a first end 84 having a slot 86 for receiving a tool. Each bolt 82 passes through a slot 87 in the internal wall structure 24. The opposite end 88 of each respective retention bolt 82 is seated within full hoop flange assembly 90 on the mating body 80. The full hoop flange assembly 90 may be threaded to engage mating threads on the end 88 of the bolt 82.

The mating system of the present invention is advantageous in that it provides radial stability and proper positioning of the duct pipe halfs 14 and 16 relative to the flange 12. The mating system lessens the complexity for a mechanic to assemble and remove a multi-detailed part that will be used frequently for inspections and evaluations. The mating system of the present invention allows for longer part life and low cost manufacturing and maintenance.

Figure 9:
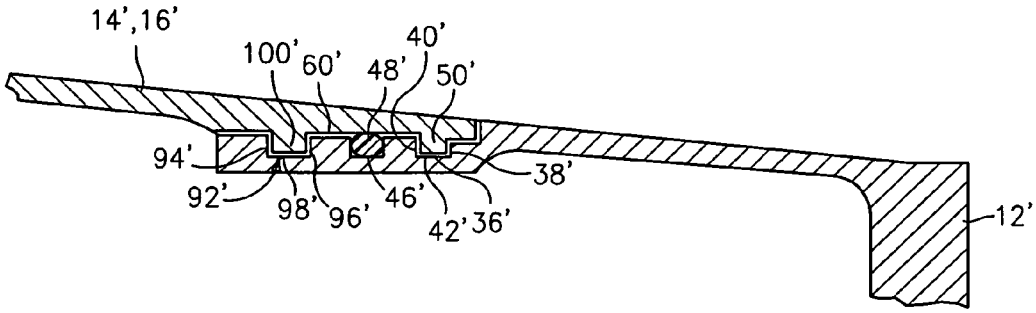
FIG. 9 is a sectional view of a first alternative embodiment of a mating system for joining a duct pipe half to a flange.

Referring now to FIG. 9, there is shown an alternative system for mating a duct pipe half 14' or 16' to a full hoop annular flange 12'. In this alternative system, the flange 12' is provided with a first groove 36' have a pair of opposed planar walls 38' and 40' and a substantially planar wall 42' joining the walls 38' and 40'. While the groove 36' has been illustrated as being substantially U-shaped, if desired, the walls 38' and 40' may be angled with respect to the wall 42' to form a substantially V-shaped groove.

Additionally, the flange 12' is provided with a second groove. 92' having a pair of opposed planar walls 94' and 96' and a substantially planar wall 98' joining the walls 94' and 96'. Here again, while the groove 92' has been illustrated as being substantially U-shaped, the walls 94' and 96' may be angled with respect to the wall 98' to form a substantially V-shaped groove.

Still further, the flange 12' is provided with a third groove 46' for receiving a sealing element 48' such as an O-ring. Preferably, the groove 46' is positioned between the grooves 36' and 92'.

The duct pipe half 14' or 16' is provided with a pair of spaced apart tongues 50' and 100'. The tongues 50' and 100' are respectively inserted into the grooves 36' and 92'. A substantially planar portion 60' extends between the tongues 50' and 100'. The substantially planar portion 60' overlaps the groove 46' and presses against the sealing element 48' to compress it.

Figure 10:
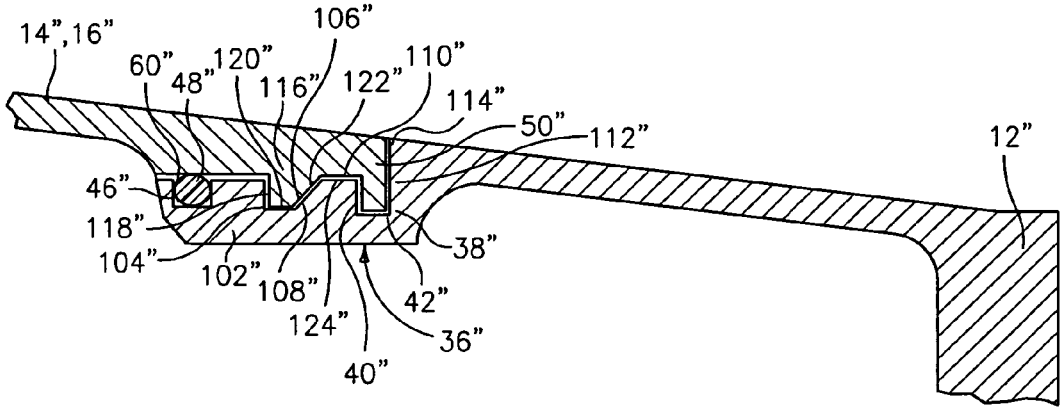
FIG. 10 is a sectional view of a second alternative embodiment of a mating system for joining a duct pipe half to a flange.

Referring now to FIG. 10, there is shown yet another alternative embodiment of a mating system for joining a duct pipe half 14" or 16" to a full hoop annular flange 12". The flange 12" is provided with a first groove 36" have a pair of opposed planar walls 38" and 40" and a substantially planar wall 42" joining the walls 38" and 40". The flange 12" further has a second substantially V-shaped groove 102". The substantially V-shaped groove 102" may have a first planar wall 104", a second planar wall 106" which is substantially perpendicular to the first wall 104", and an angled wall 108". The flange 12" also has a third groove 46" for receiving a sealing element 48", such as an O-ring.

The duct pipe half 14" or 16" is provided with a first tongue 50" for insertion into the groove 36". The tongue 50" may have two planar walls 110" and 112" joined together by a planar wall 114". The duct pipe half 14" or 16" also has a second tongue 116" for insertion into the groove 102". The second tongue 116" has a first planar wall 118", a second planar wall 120" perpendicular to the first wall 118", and a wall 122" angled relative to the wall 120". The wall 122" abuts the wall 108" when the duct pipe half 14" or 16" is positioned relative to the flange 12". A planar wall 124" extends between the tongues 50" and 116". The duct pipe half 14" or 16" is preferably provided with another planar portion 60" which overlaps the groove 46" and compresses the sealing element 48" when the duct pipe half 14" or 16" is positioned with respect to the flange 12".

It is apparent that there has been provided in accordance with the present invention a split flange, V-groove and anti-rotation mating system which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modification, and variations as fall within the broad scope of the appended claims.

What is claimed is:

1. A turbine engine component comprising:

an annular flange;

at least one element to be mated to the flange;

mating means for joining said at least one element to said flange, said mating means including a first annular groove in said flange;

said first annular groove having two opposed planar wall portions for preventing movement of said at least one element relative to said flange; and said mating means further comprising means for preventing rotation of said at least one element relative to said flange.

2. The turbine engine component according to claim 1, further comprising said annular groove having a flat portion connecting said two planar wall portions.

3. The turbine engine component according to claim 1, further comprising said annular groove having an angled wall portion adjacent one of said planar wall portions for providing hoop strength.

4. The turbine engine component according to claim 3, further comprising said at least one element having a mating angled wall portion which contacts said angled wall portion on said flange.

5. The turbine engine component according to claim 4, wherein said at least one element further has a tongue adjacent said mating angled wall portion and said tongue fitting between said two planar wall portions of said groove.

6. The turbine engine component according to claim 4, wherein mating system further comprises a second annular groove in said flange and a sealing element seated in said second annular groove and wherein said at least one element further has a substantially planar portion adjacent said mating angled wall portion for overlapping said second annular groove and abutting said sealing element.

7. The turbine engine component according to claim 6, wherein said sealing element comprises an O-ring.

8. The turbine engine component according to claim 6, wherein said at least one element comprises a first semi-annular component and a second semi-annular component for mating with said flange.

9. The turbine engine component according to claim 8, further comprising said first semi-annular component having a first connection element, said second semi-annular component having a second connection element which aligns with said first connection element, and fastener means for joining said first connection element to said second connection element, whereby when said first connection element is joined to said second connection element said sealing element is compressed by said first and second semi-annular components.

10. The turbine engine component according to claim 9, further comprising one of said semi-annular components having a door for gaining access to said fastener means and a deflectable baffle assembly.

11. The turbine engine component according to claim 10, wherein said deflectable baffle assembly comprises a plurality of baffle members joined to said one of said semi-annular components.

12. The turbine engine component according to claim 1, wherein said rotation preventing means comprises an anti-rotation pin joined to said flange and said at least one element has a slot for receiving a portion of said anti-rotation pin.

13. The turbine engine component according to claim 1, further comprising:

said mating means including a second annular groove in said flange; and said second annular groove having two opposed planar wall portions for preventing axial movement of said at least one element relative to said flange.

14. The turbine engine component according to claim 13, wherein said at least one element has two spaced apart tongue members for engaging said first and second annular grooves.

15. The turbine engine component according to claim 14, further comprising a third annular groove in said flange, a sealing element in said third annular groove, and said at least one element having a substantially planar portion for compressing said sealing element.

16. The turbine engine component according to claim 15, wherein said sealing element comprises an O-ring.

17. The turbine engine component according to claim 15, wherein said third groove is positioned between said first and second grooves.

18. The turbine engine component according to claim 1, further comprising:

said mating means including a second annular groove in said flange; and said second annular groove being substantially V-shaped for preventing movement of said at least one element relative to said flange.

19. The turbine engine component according to claim 18, wherein said substantially V-shaped groove has a first planar wall, a second planar wall at an angle with respect to said first planar wall, and a third planar wall joining said first and second walls.

20. A turbine engine component comprising:

an annular flange;

at least one element to be mated to the flange;

mating means for joining said at least one element to said flange, said mating means including a first annular groove in said flange;

said first annular groove having two opposed planar wall portions for preventing movement of said at least one element relative to said flange; and said mating means further comprising means for allowing said at least one element to be locked and unlocked relative to said flange.

21. The turbine engine component according to claim 20, wherein said means for allowing said at least one element to be locked and unlocked comprises a pin inserted into a slot in said flange and a bayonet slot in an end wall of said at least one element.

22. The turbine engine component according to claim 21, wherein said bayonet slot has a notch that allows said at least one element to move between a locked position and an unlocked position.

23. A turbine engine component comprising:

an annular flange;

at least one element to be mated to the flange;

mating means for joining said at least one element to said flange, said mating means including a first annular groove in said flange;

said first annular groove having two opposed planar wall portions for preventing movement of said at least one element relative to said flange; and means for joining said flange to a mating body.

24. The turbine engine component according to claim 23, wherein said joining means comprises a full hoop flange assembly incorporated into said mating body and a flange retention bolt which passes through said annular flange and wherein said flange retention bolt fits into said full hoop flange assembly.

25. An annular flange comprising:

a first annular groove in said flange;

said first annular groove having a first planar wall and a second planar wall;

a third planar wall adjacent said second planar wall, said third planar wall being angled with respect to said second planar wall so as to form a substantially V-shaped groove with said first planar wall; and a leading edge and a first slot in said leading edge for receiving an anti-rotation pin.

26. The annular flange according to claim 25, wherein said first planar wall has a length greater than the length of said second planar wall.

27. annular flange according to claim 25, further comprising a second annular groove for receiving a sealing element.

28. The annular flange according to claim 25, further comprising a second slot in said leading edge for receiving a locking and unlocking pin.

29. The annular flange according to claim 28, wherein said second slot is diametrically opposed to said first slot.

30. The annular flange according to claim 25, further comprising an internal wall structure adjacent a trailing edge of said flange.

31. The annular flange according to claim 30, wherein said internal wall structure has a plurality of slots for receiving a plurality of retention bolts.

* * * * *

UNITED STATES PATENT AND TRADEMARK OFFICE

CERTIFICATE OF CORRECTION

PATENT NO. : 7,435,050 B2
APPLICATION NO. : 11/329554
DATED : October 14, 2008
INVENTOR(S) : David A. Welch It is certified that error appears in the above-identified patent and that said Letters Patent is hereby corrected as shown below:

In column 8, claim 27, line 8, before “annular”, insert --The--.

Signed and Sealed this

Tenth Day of March, 2009

JOHN DOLL
*Acting Director of the United States Patent and Trademark Office*